US009849957B1

(12) United States Patent
Grahl et al.

(10) Patent No.: US 9,849,957 B1
(45) Date of Patent: Dec. 26, 2017

(54) SYSTEMS AND STEERING ACTUATORS FOR STEERING OUTBOARD MARINE ENGINES

(71) Applicant: Brunswick Corporation, Lake Forest, IL (US)

(72) Inventors: Flint Grahl, Fond du Lac, WI (US); John A. Groeschel, Theresa, WI (US)

(73) Assignee: Brunswick Corporation, Mettawa, IL (US)

( * ) Notice: Subject to any disclaimer, the term of this patent is extended or adjusted under 35 U.S.C. 154(b) by 384 days.

(21) Appl. No.: 14/674,688

(22) Filed: Mar. 31, 2015

(51) Int. Cl.
*B63H 20/12* (2006.01)
*B63H 20/32* (2006.01)

(52) U.S. Cl.
CPC ..... *B63H 20/12* (2013.01); *B63H 20/32* (2013.01)

(58) Field of Classification Search
CPC ... F15B 13/0444; F15B 15/2892; B63H 20/12
USPC ..... 91/378, 380, 435
See application file for complete search history.

(56) References Cited

U.S. PATENT DOCUMENTS 2,871,830 A * 2/1959 Wirth ..... F15B 9/12 244/78.1
3,310,284 A * 3/1967 Inaba ..... F15B 9/14 137/625.18
3,645,296 A 2/1972 Adams
3,712,582 A 1/1973 Moesta
3,892,164 A * 7/1975 Magor ..... F15B 9/10 91/378
3,939,938 A * 2/1976 Inoue ..... B62D 5/001 180/422
4,146,244 A * 3/1979 Presley ..... B62D 5/22 180/428
4,200,030 A 4/1980 Elser
4,362,515 A 12/1982 Ginnow
4,593,780 A 6/1986 Saito
4,841,790 A 6/1989 Williston et al.
5,074,193 A 12/1991 Hundertmark
5,129,273 A 7/1992 Fukui et al.
5,224,888 A 7/1993 Fujimoto et al.
5,376,029 A * 12/1994 Entringer ..... B63H 25/30 114/144 R (Continued)

OTHER PUBLICATIONS

Joy Piloting System Installation Manual, 90-8M0093151 May 2014, particularly Section 5.

*Primary Examiner* — Thomas E Lazo
*Assistant Examiner* — Matthew Wiblin
(74) *Attorney, Agent, or Firm* — Andrus Intellectual Property Law, LLP

(57) ABSTRACT

A steering actuator is for steering an outboard marine engine about a steering axis. The steering actuator comprises a housing; a piston device that is disposed in the housing, wherein hydraulic actuation of the piston device causes the outboard marine engine to pivot about the steering axis; and a valve device that is disposed in the housing. The valve device controls a flow of a hydraulic fluid to move the piston device in a first piston direction and to move the piston device in an opposite, second piston direction. Movement of the piston device in the first piston direction causes the outboard marine engine to pivot in a first pivot direction and movement of the piston device in the second piston direction causes the outboard marine engine to pivot in an opposite, second pivot direction.

16 Claims, 10 Drawing Sheets

(56) References Cited

U.S. PATENT DOCUMENTS

| | | | | |
|---|---|---|---|---|
| 5,392,690 | A | 2/1995 | Hundertmark | |
| 5,447,456 | A * | 9/1995 | Nakayasu | B63H 21/265 114/150 |
| 5,471,907 | A | 12/1995 | Kobelt | |
| 5,603,279 | A | 2/1997 | Hundertmark et al. | |
| 5,775,102 | A * | 7/1998 | Frye | B62D 5/065 60/431 |
| 5,881,991 | A | 3/1999 | Bonin | |
| 5,947,155 | A | 9/1999 | Miki et al. | |
| 6,065,451 | A | 5/2000 | Lebrun | |
| 6,113,444 | A | 9/2000 | Ritger | |
| 6,234,853 | B1 | 5/2001 | Lanyi et al. | |
| 6,276,977 | B1 | 8/2001 | Treinen et al. | |
| 6,354,184 | B1 | 3/2002 | Hansen et al. | |
| 6,402,577 | B1 * | 6/2002 | Treinen | B63H 20/12 440/61 C |
| 6,755,703 | B1 | 6/2004 | Erickson | |
| 6,821,168 | B1 * | 11/2004 | Fisher | B63H 25/28 114/150 |
| RE39,032 | E | 3/2006 | Gonring et al. | |
| 7,131,385 | B1 | 11/2006 | Ehlers et al. | |
| 7,150,664 | B1 | 12/2006 | Uppgard et al. | |
| 7,168,360 | B2 | 1/2007 | Massaccesi et al. | |
| 7,255,616 | B1 | 8/2007 | Caldwell | |
| 7,284,634 | B2 | 10/2007 | Tatewaki et al. | |
| 7,311,572 | B2 | 12/2007 | Yamashita et al. | |
| 7,699,674 | B1 | 4/2010 | Wald et al. | |
| 8,246,398 | B2 | 8/2012 | Inaba | |
| 2003/0150367 | A1 | 8/2003 | Hundertmark | |
| 2005/0170712 | A1 | 8/2005 | Okuyama | |
| 2007/0137327 | A1 | 6/2007 | Heitzer | |
| 2008/0113571 | A1 | 5/2008 | Zelm et al. | |
| 2015/0367924 | A1 * | 12/2015 | Davis | B63H 20/002 440/53 |

* cited by examiner

SYSTEMS AND STEERING ACTUATORS FOR STEERING OUTBOARD MARINE ENGINES

FIELD

The present disclosure relates to outboard marine engines and more particularly to systems and steering actuators for steering outboard marine engines.

BACKGROUND

The following U.S. Patent Applications are incorporated herein by reference, in entirety.

U.S. Pat. No. 7,255,616 discloses a steering system for a marine propulsion device that eliminates the need for two support pins and provides a hydraulic cylinder with a protuberance and an opening which cooperate with each other to allow a hydraulic cylinder's system to be supported by a single pin for rotation about a pivot axis. The single pin allows the hydraulic cylinder to be supported by an inner transom plate in a manner that allows it to rotate in conformance with movement of a steering arm of a marine propulsion device.

U.S. Pat. No. 7,150,664 discloses a steering actuator system for an outboard motor that connects an actuator member to guide rails which are, in turn, attached to a motive member such as a hydraulic cylinder. The hydraulic cylinder moves along a first axis with the guide rail extending in a direction perpendicular to the first axis. An actuator member is movable along the guide rail in a direction parallel to a second axis and perpendicular to the first axis. The actuator member is attached to a steering arm of the outboard motor.

U.S. Pat. No. 6,821,168 discloses an outboard motor that is provided with an internally contained cylinder and moveable piston. The piston is caused to move by changes in differential pressure between first and second cavities within the cylinder. By adding a hydraulic pump and a steering valve, the hydraulic steering system described in U.S. Pat. No. 6,402,577 is converted to a power hydraulic steering system by adding a hydraulic pump and a steering valve to a manual hydraulic steering system.

U.S. Pat. No. 6,402,577 discloses a hydraulic steering system in which a steering actuator is an integral portion of the support structure of a marine propulsion system. A steering arm is contained completely within the support structure of the marine propulsion system and disposed about its steering axis. An extension of the steering arm extends into a sliding joint which has a linear component and a rotational component which allow the extension of the steering arm to move relative to a moveable second portion of the steering actuator. The moveable second portion of the steering actuator moves linearly within a cylinder cavity formed in a first portion of the steering actuator.

U.S. Pat. No. 6,276,977 discloses a hydraulic actuator for an outboard motor system in which the cylinder and piston of the actuator are disposed within a cylindrical cavity inside a cylindrical portion of a swivel bracket. The piston within the cylinder of the actuator is attached to at least one rod that extends through clearance holes of a clamp bracket and is connectable to a steering arm of an outboard motor. The one or more rods attached to the piston are aligned coaxially with an axis of rotation about which the swivel bracket rotates when the outboard motor is trimmed. As a result, no relative movement occurs between the outboard motor, the rod attached to the piston of the actuator, and the swivel bracket during rotation of the outboard motor about the axis of rotation.

U.S. Pat. No. 6,113,444 discloses a rotary actuator used to steer a watercraft with an outboard motor. First and second brackets are attached to the outboard motor and the transom of the watercraft, respectively. The rotary actuator can be a hydraulic rotary actuator and either the rotor portion or stator portion of the rotary actuator can be attached to the outboard motor with the other portion being attached to the transom. A hydraulic pump is used to provide pressurized fluid to the actuator and a valve is used to selectively direct the pressurized fluid to one of two ports in the rotary actuator to select the directional rotation and speed between the stator portion and the rotor portion.

U.S. Pat. No. 5,392,690 discloses a marine hydraulic system for operation of a power steering assembly that includes a pressure accumulator to provide pressurized hydraulic fluid and valving that permits the transfer of hydraulic fluid within the cylinder to provide efficient use of hydraulic fluid.

U.S. Pat. No. 5,376,029 discloses a control valve for a pressurized fluid-operated system, such as a marine power steering system, which includes a housing having an inlet and at least one outlet, with one or more work ports located therebetween. Pressurized fluid is supplied to the inlet, and a spool member is mounted within the housing for controlling the supply of pressurized fluid to a work-performing system, such as the extendible and retractable rod of a hydraulic cylinder assembly. The spool member includes structure for blocking the one or more work ports when the spool member is in its neutral position, when it is desired not to operate the system. This prevents the cylinder from being exposed to reservoir fluid when the spool member is in its neutral position.

U.S. Pat. No. 5,074,193 discloses a marine hydraulic system for operation of a power steering assembly that includes a pressure accumulator to provide pressurized hydraulic fluid and valving that permits the transfer of hydraulic fluid within the cylinder to provide efficient use of hydraulic fluid.

U.S. Pat. No. 4,362,515 discloses an improved steering system having a guide tube fixed to the end of the outer casing of a steering cable. A link rod connects between the steering arm and the inner core of the steering cable. A guide means is fixed with respect to the transom support means to guide the linear movement of the inner core. A limiting means limits the range of movement of the inner core and a restoring means moves the steerable drive unit from the extreme range of the range of movement of the ram.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

In certain examples, a steering actuator is for steering an outboard marine engine about a steering axis. The steering actuator comprises a housing; a piston device that is disposed in the housing, wherein hydraulic actuation of the piston device causes the outboard marine engine to pivot about the steering axis; and a valve device that is disposed in the housing. The valve device controls a flow of a hydraulic fluid to a first side of the piston device to move the piston device in a first piston direction in the housing and to an opposite, second side of the piston device to move the piston device in an opposite, second piston direction in the housing. Movement of the piston device in the first piston direction causes the outboard marine engine to pivot in a first pivot direction and movement of the piston device in the second piston direction causes the outboard marine engine to pivot in an opposite, second pivot direction. Advantageously, a rigid position reference link that rigidly connects the valve device to the piston device is entirely disposed in the housing. Corresponding systems are disclosed having the steering actuator for steering an outboard marine engine about a steering axis.

BRIEF DESCRIPTION OF THE DRAWINGS

The present disclosure is described with reference to the following drawing Figures. The same numbers are used throughout the drawing Figures to reference like features and like components.

DETAILED DESCRIPTION OF THE DRAWINGS

Figure 1:
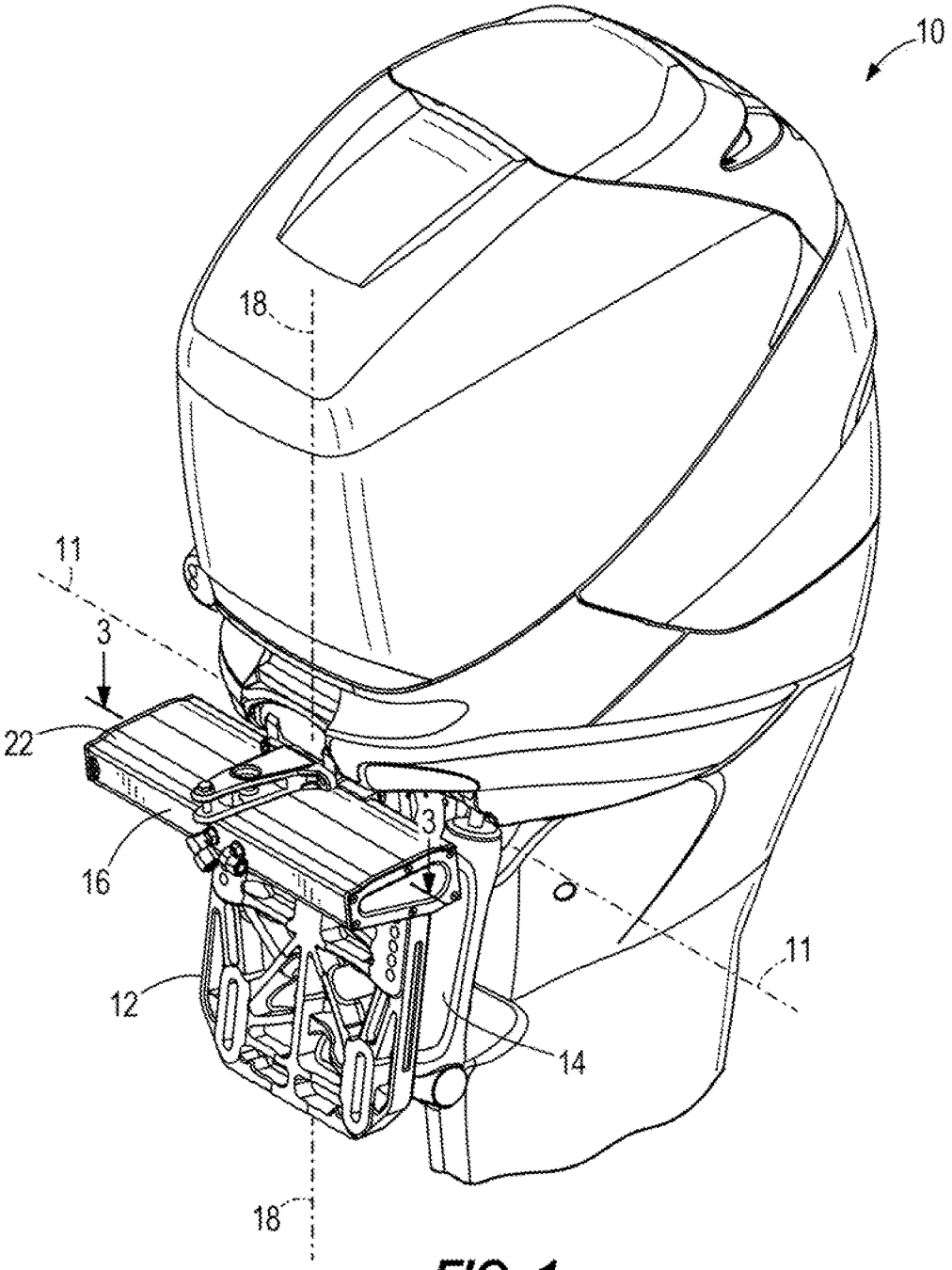
FIG. 1 is a perspective view of an outboard marine engine having a steering actuator.
Figure 2:
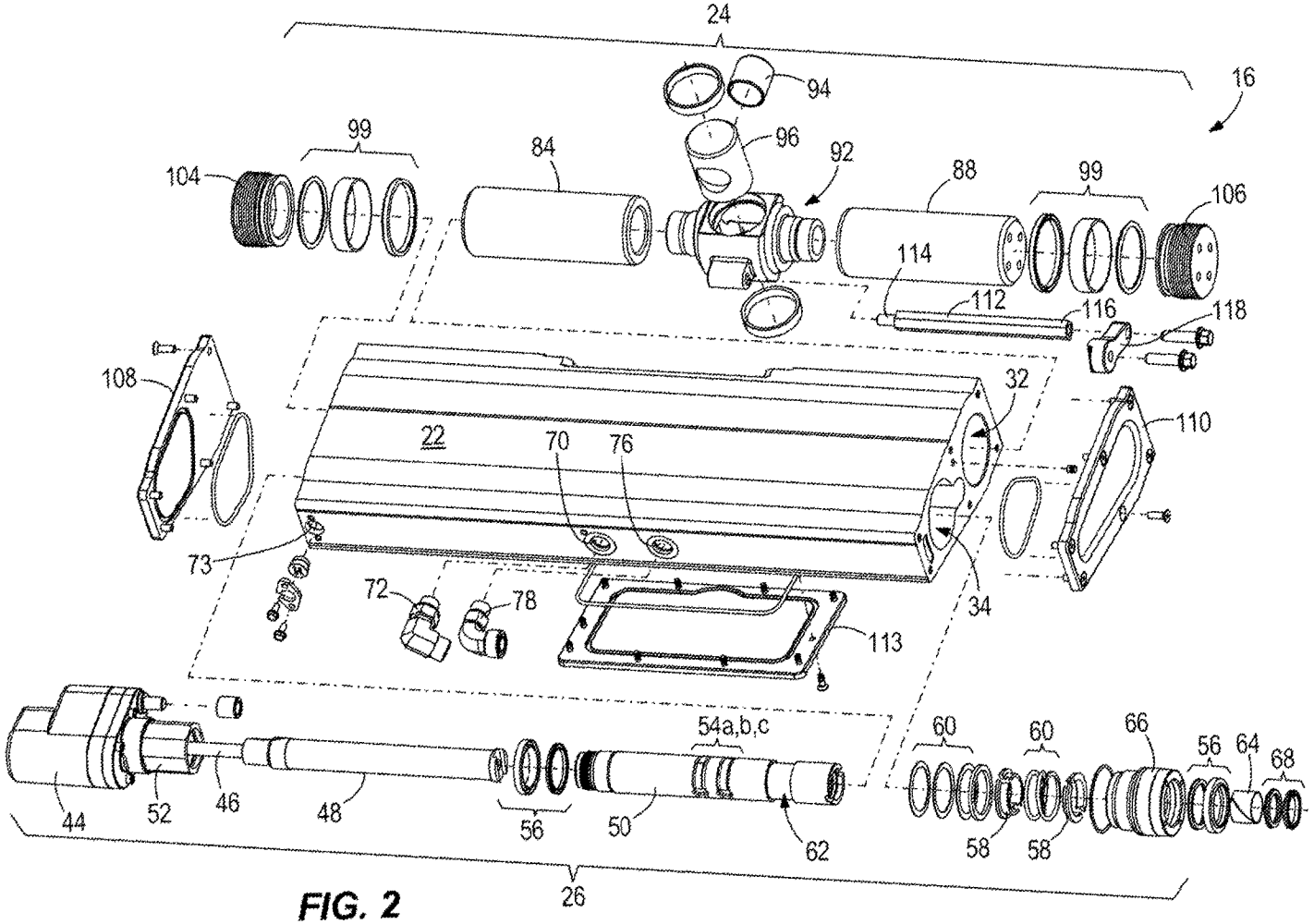
FIG. 2 is an exploded view of an exemplary steering actuator.
Figure 4A:
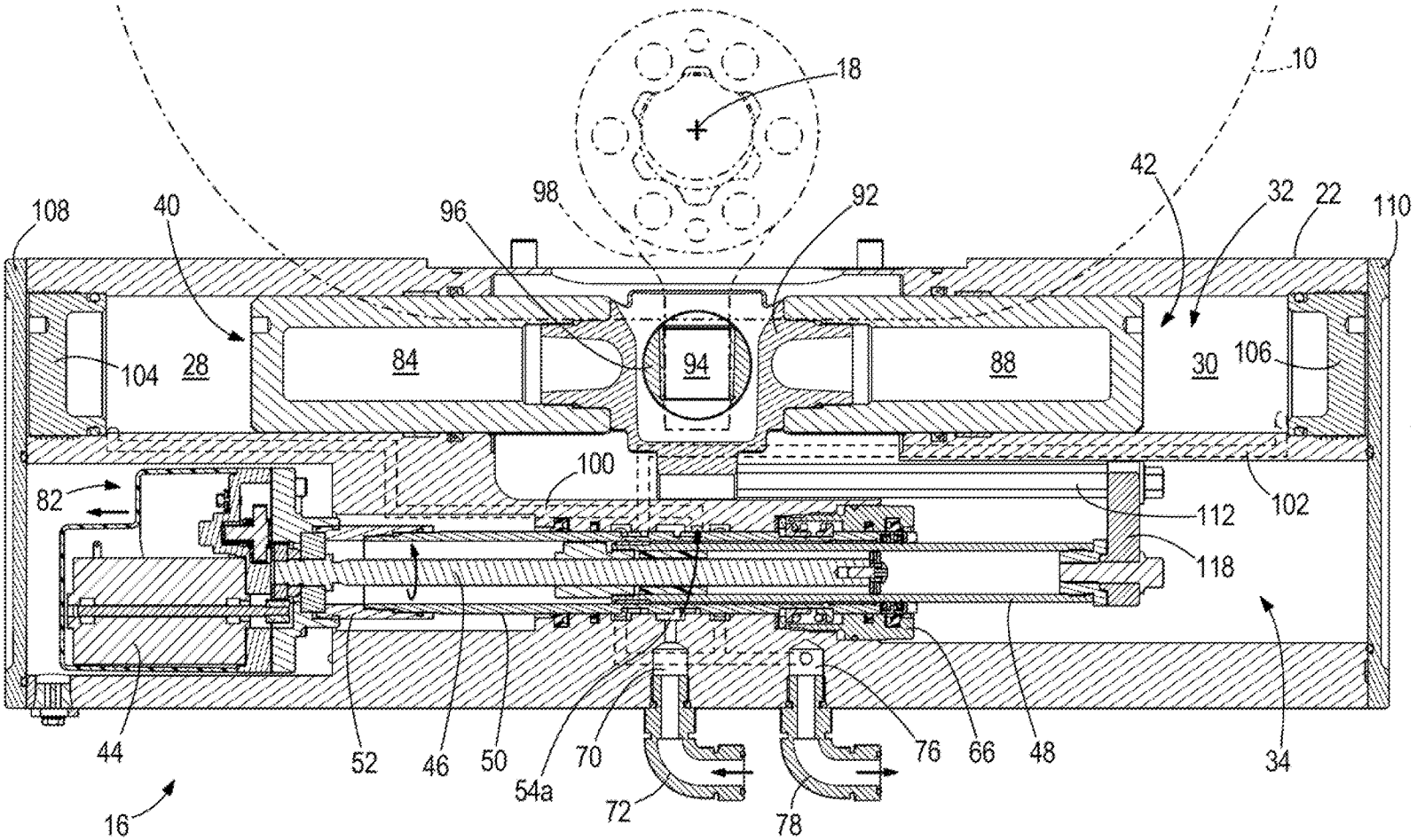
FIG. 4A is a sectional view of the steering actuator, showing movement of a valve device into a first position.
Figure 4B:
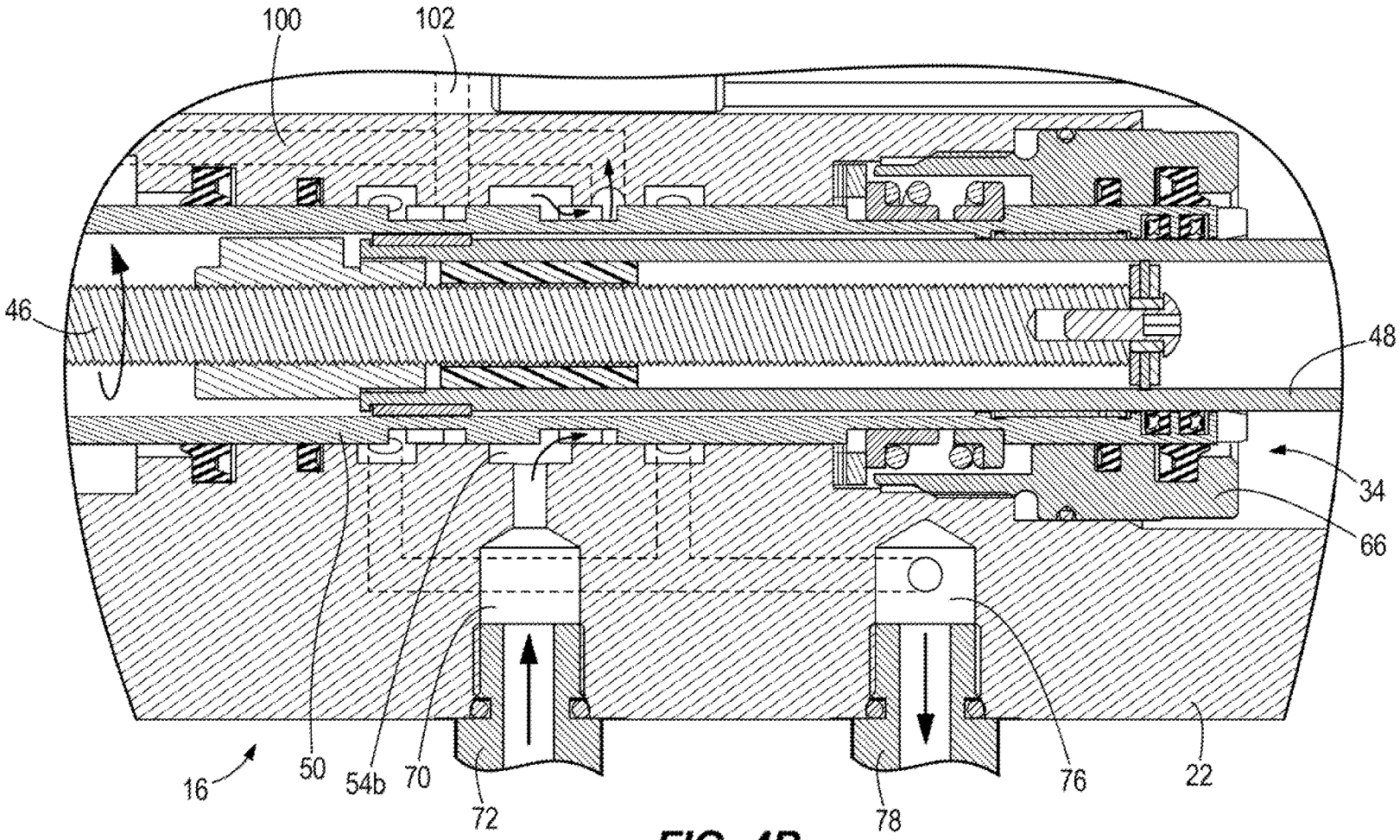
FIG. 4B is a closer sectional view of the valve device shown in FIG. 4A.

FIG. 1 depicts an outboard marine engine 10 and a conventional transom plate 12 for mounting the outboard marine engine 10 on the stern of a marine vessel. A pair of conventional trim cylinders 14 (only one is shown in FIG. 1) are configured to trim the outboard marine engine 10 about a horizontal trim axis 11. A steering actuator 16 is configured to steer the outboard marine engine 10 about a vertical steering axis 18. FIG. 1 shows the steering actuator 16 and FIG. 6 shows a control system 20 for the steering actuator 16. Examples of the steering actuator 16 and the control system 20 are the primary focus of the present disclosure. FIG. 2 shows the steering actuator 16 in exploded view. FIGS. 3-5C depict the steering actuator 16 during various operational positions, which occur as the control system 20 causes the outboard marine engine 10 to pivot in first and second pivot directions about the vertical steering axis 18, as will be explained further herein below.

Referring now to FIGS. 2 and 6, the steering actuator 16 includes a housing 22 that contains a piston device 24 and a valve device 26. Hydraulic actuation of the piston device 24 causes the outboard marine engine 10 to pivot in the first pivot direction (shown in FIG. 4C) about the vertical steering axis 18 and alternately to pivot in the opposite second pivot direction (shown in FIG. 5C) about the vertical steering axis 18. The valve device 26 controls the hydraulic actuation of the piston device 24 by controlling a flow of hydraulic fluid to first and second sides 28, 30 of the piston device 24 to thereby cause movement the piston device 24 in first and opposite, second piston directions in the housing 22. Detailed structural and operational features of the piston device 24 and the valve device 26 will be further described herein below with reference it FIGS. 3-5C.

The housing 22 defines parallel, axially-extending first and second cavities 32, 34, which are best seen in FIGS. 3-5C. The piston device 24 is disposed in the first cavity 32 and the valve device 26 is disposed in the second cavity 34. A further described herein below, the valve device 26 moves amongst three positions within the second cavity 34, including a neutral position (shown in FIGS. 3, 4C, 5C and 6) wherein the valve device 26 directs a flow of hydraulic fluid from a pump 36 back to a hydraulic fluid supply tank 38, a first valve position (shown in FIGS. 4A and 4B) wherein the valve device 26 directs the flow of hydraulic fluid to a first side 40 of the piston device 24, and a second valve position (shown in FIGS. 5A and 58) wherein the valve device 26 directs the flow of hydraulic fluid to a second side 42 of the piston device 24.

Referring now to FIG. 6, the control system 20 includes a computer controller 120 that is programmable and includes a computer processor, software, memory (i.e. computer storage) and an associated input/output (interface) device. The processor loads and executes software, which can be stored in the memory. Executing the software controls the control system 20 to operate as described herein in further detail below. The processor can comprise a microprocessor and/or other circuitry that receives and executes software. The processor can be implemented within a single device, but can also be distributed across multiple processing devices and/or subsystems that cooperate in executing program instructions. Examples include general purpose central processing units, application specific processors, and logic devices, as well as any other processing device, combination of processing devices, and/or variations thereof. The controller 120 can be located anywhere with respect to the outboard marine engine 10 and associated marine vessel and can communicate with various components of the control system 20 via wired and/or wireless links, examples of which are shown in FIG. 6. The controller 120 can have one or more microprocessors that are located together or remotely from each other in the control system 20 or remotely from the system 20.

The memory can include any storage media that is readable by the processor and capable of storing software. The memory can include volatile and/or non-volatile removable and or non-removable media implemented in any method or technology for storage of information, such as computer readable instructions, data structures, program modules, or other data. The memory can be implemented as a single storage device but may also be implemented across multiple storage devices or subsystems. The memory can further include additional elements such as a controller capable of communicating with the processor. Examples of storage media include random access memory, read only memory, magnetic discs, optical discs, flash memory discs, virtual and/or non-virtual, magnetic cassettes, magnetic tape, magnetic disc storage, or other magnetic storage devices, or any other medium which can be used to store the desired information that may be accessed by an instruction execution system, as well as any combination or variation thereof, or any other type of storage media. In some implementations, the storage media can be non-transitory storage media.

The input/output device can include any one of a variety of conventional computer input/output interfaces for receiving electrical signals for input to the processor and for sending electrical signals from the processor to various components of the control system 20. The controller 120, via the noted input/output device, communicates with components of the outboard marine engine 10 via communication links, which as mentioned herein above can be wired or wireless links. As explained further herein below, the controller 120 is capable of monitoring and controlling operational characteristics of the outboard marine engine 10 by sending and/or receiving control signals via the various links shown in FIG. 6. Although the links are each shown as a single link, the term "link" can encompass one or a plurality of links that are each connected to one or more of the components of the control system 20.

In some examples, the controller 120 is configured to receive inputs from a user input device 122, which can for example include a conventional steering wheel, joystick, touch pad, touch screen and/or the like. Such input devices for inputting operator steering commands to a controller 120 are well known in the art and therefore are not further herein described. The controller 120 is configured to output control signals to the steering actuator 16 to for example control the valve device 26, as further described herein below. In some example, the controller 120 is also or alternately configured to generate output command signals that control the valve device 26 based upon programming stored within the memory of the controller 120, such as for example in stationkeeping modes, trolling modes, waypoint tracking modes, and/or the like, all of which are well-known by those having ordinary skill the art.

Referring to FIGS. 2 and 6, the valve device 26 includes an electrically-powered bidirectional motor 44 that is controlled by the controller 120 to cause rotation of an output shaft 46 about its own axis in a first rotational direction and to cause rotation of the output shaft 46 about its own axis in an opposite, second rotational direction. The output shaft 46 extends into and engages with a hollow output sleeve 48 via threads (best shown in FIGS. 3-5C) on the outer circumference of the output shaft 46 that mate with corresponding threads on the inner circumference of the hollow output sleeve 48. The hollow output sleeve 48 extends into and is axially slideable with respect to a hollow spool 50 that is fixedly coupled to the bidirectional motor 44 via a threaded connector 52. By the threaded connection, rotation of the output shaft 46 in the noted first rotational direction causes axial travel of the hollow output sleeve 48 out of the spool 50. Rotation of the output shaft 46 in the noted second rotational direction causes opposite axial travel of the hollow output sleeve 48 into the spool 50.

Referring to FIGS. 2 and 6, the outer circumference of the spool 50 defines oil passages 54*a*, 54*b*, 54*c* for conveying the flow of hydraulic fluid to the first side 28 of the piston device 24 (via 54*a*), to the second side 30 of the piston device 24 (via passage 54*c*) and back to the tank (via passage 54*b*). The oil passages 54*a*, 54*b*, 54*c* are best shown schematically in FIG. 6, but are also called out in FIG. 2. Fluid-tight wiper and seal combinations 56 are disposed on the outer circumference of the spool 50, on opposite axial sides of the noted oil passages 54*a*, 54*b*. Pairs of oppositely-oriented spring retainers 58 and Belleville washer springs 60 are disposed in a spring-receiving groove 62 formed in the outer circumference of the spool 50. Bearings 64 are disposed on the output sleeve 48 and facilitate movement of the output sleeve 48 relative to the spool 50. An end cap 66 is threadingly received in the second cavity 34 of the housing 22 and abuts against an end of the spool 50. Additional fluid-tight seals 68 are disposed between the end cap 66 and the spool 50.

The housing 22 has a hydraulic fluid inlet 70 to which an inlet fitting 72 is connected. The inlet fitting 72 couples an inlet line 74 to the inlet 70 for providing the flow of hydraulic fluid from the pump 36 to the valve device 26. The housing 22 also has a hydraulic fluid outlet 76 to which an outlet fitting 78 is connected. The outlet fitting 78 couples an outlet line 80 to the outlet 76 for providing the flow of hydraulic fluid from the valve device 26 to the tank 38. During assembly of the actuator 16, the valve device 26 is inserted into one end of the second cavity 34 and the end cap 66 is threaded onto an opposite end of the second cavity 34 so as to place the valve device 26 in the noted neutral position. More specifically, threading of the end cap 66 onto the second cavity 34 forces the spool 50 to axially move to the left in the second cavity 34. Unthreading the end cap 66 allows the spool 50 to move to the right in the second cavity 34. The preferred start-up position for the valve device 26 is the neutral position wherein the passages 54*b* are aligned with the inlet 70 and outlet 76 so that hydraulic fluid from the pump 36 is returned back to the tank 38. The housing 22 also has a grommeted wire passage 73 formed therein for passage of electrical wires for providing power to the bidirectional motor 44 and communication links for communicating position of the valve device 26 to the controller 120.

Rotation of the output shaft 46 in the first rotational direction unthreads the output shaft 46 from the output sleeve 48 and thus causes axial, linear travel of the output sleeve 48 along the output shaft 46, away from the bidirectional motor 44. Rotation of the output shaft 46 in the first rotational direction thus moves the valve device 26 (including the spool 50) into the noted first valve position (shown in FIGS. 4A and 4B) wherein hydraulic fluid from the pump 36 is supplied to the first side 28 of the piston device 24.

Rotation of the output shaft 46 in the opposite, second rotational direction threads the output shaft 46 into the output sleeve 48 and thus causes axial, linear travel of the output sleeve 48 along the output shaft 46, towards the bidirectional motor 44. Rotation of the output shaft in the second rotational direction thus moves the valve device 26 (including the spool 50) into the second valve position (shown in FIGS. 5A and 5B) wherein hydraulic fluid from the pump 36 is supplied to the second side 30 of the piston device 24.

Figure 3:
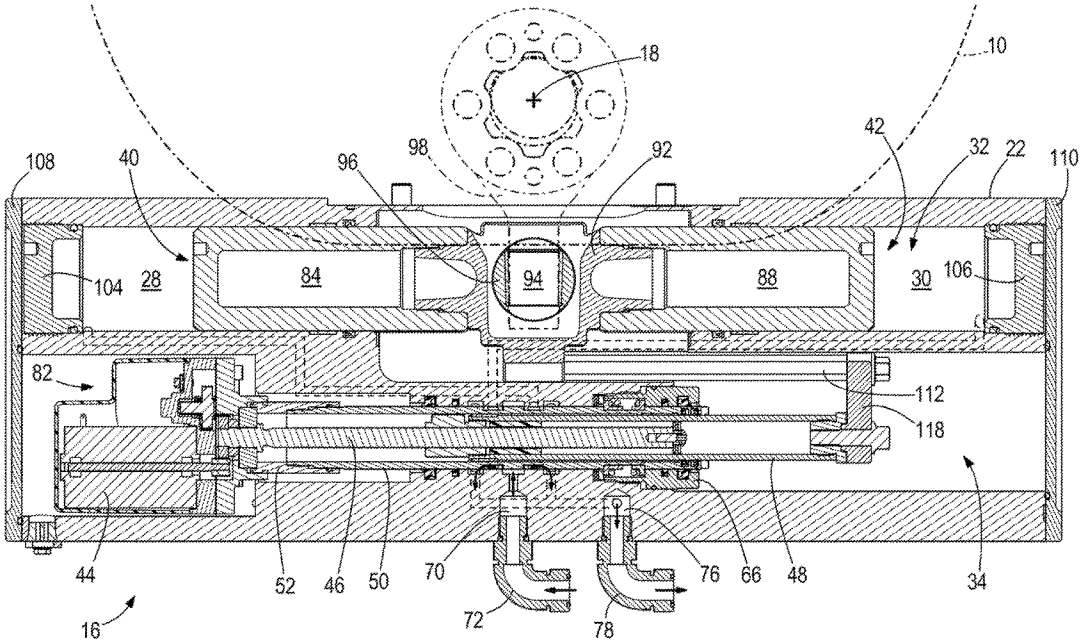
FIG. 3 is a sectional view, showing the steering actuator in a neutral position.
Figure 4C:
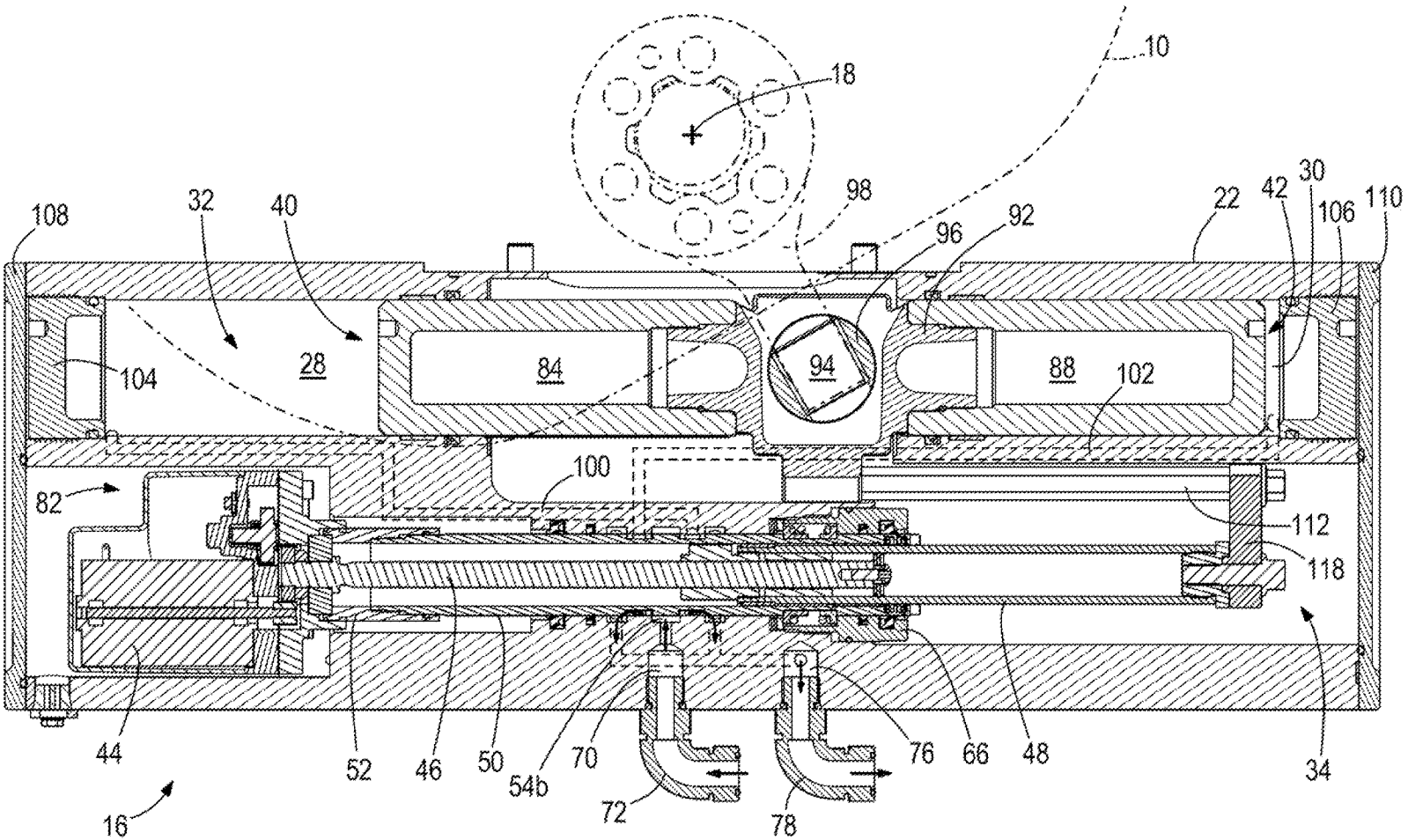
FIG. 4C is a sectional view of the steering actuator, showing the valve device back in the neutral position after pivoting movement of the outboard marine engine in a first pivot direction.
Figure 5A:
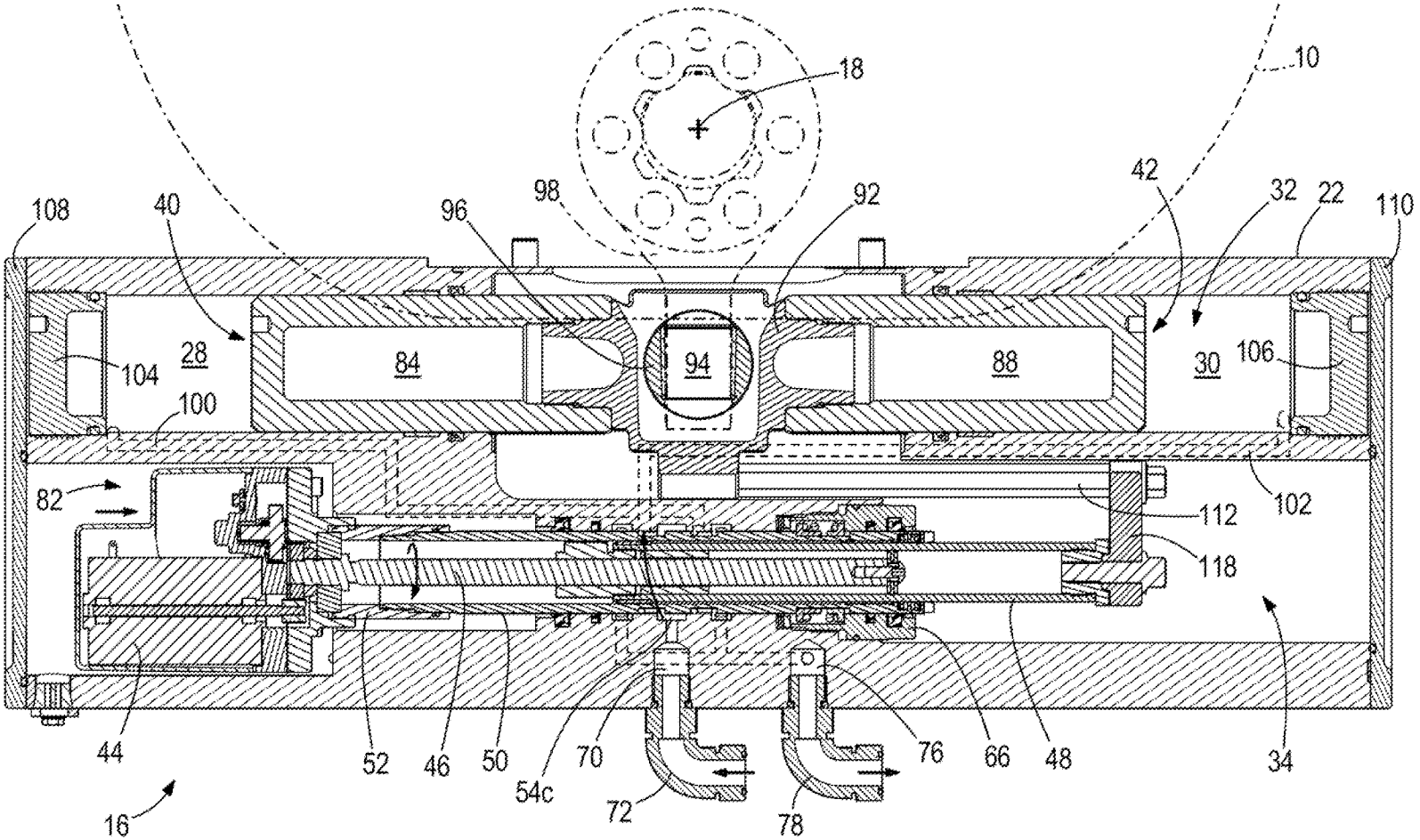
FIG. 5A is a sectional view of the steering actuator, showing movement of the valve device into a second position, opposite the first position shown in FIG. 4A.
Figure 5B:
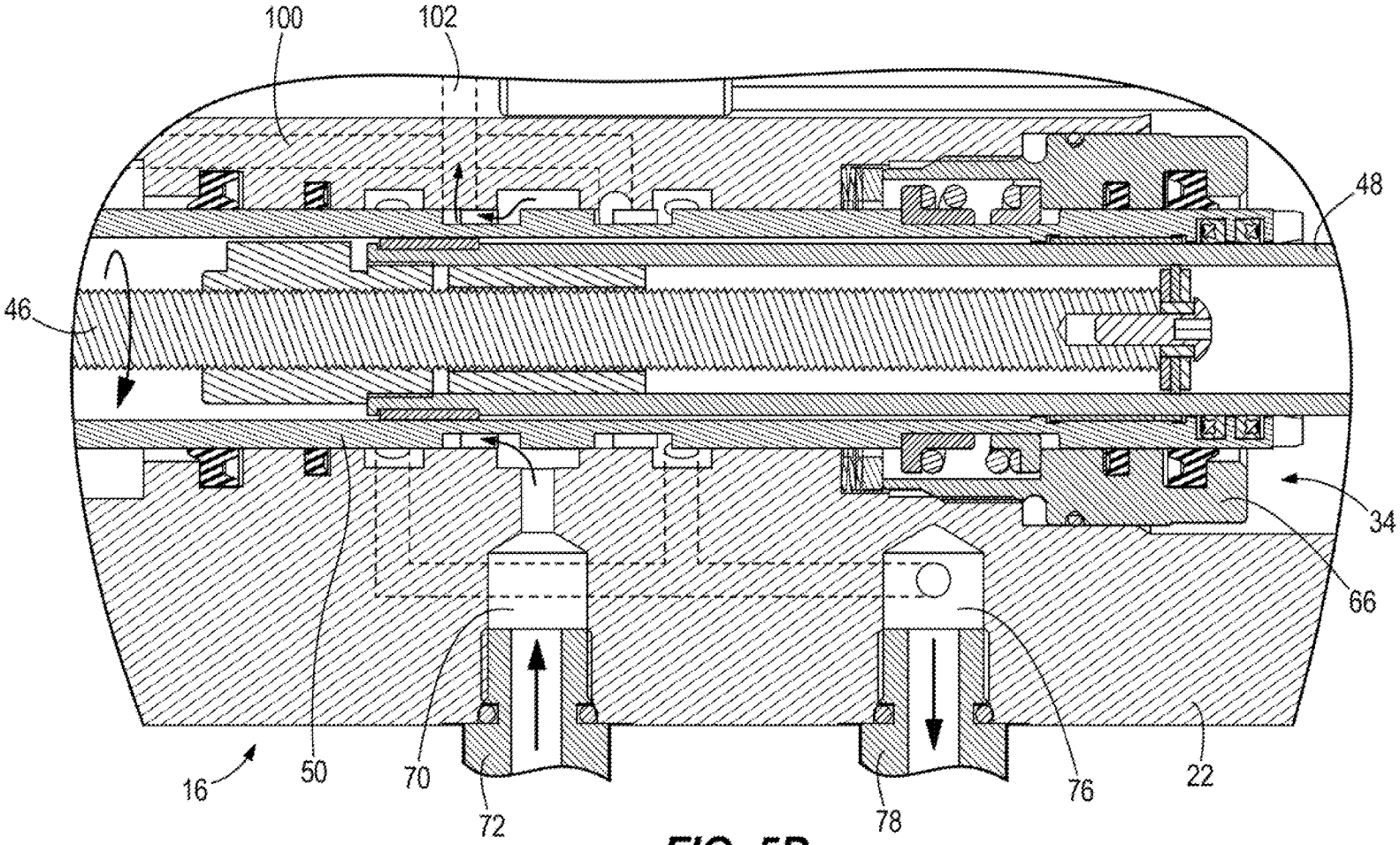
FIG. 5B is a closer sectional view of the valve device shown in FIG. 5A.
Figure 5C:
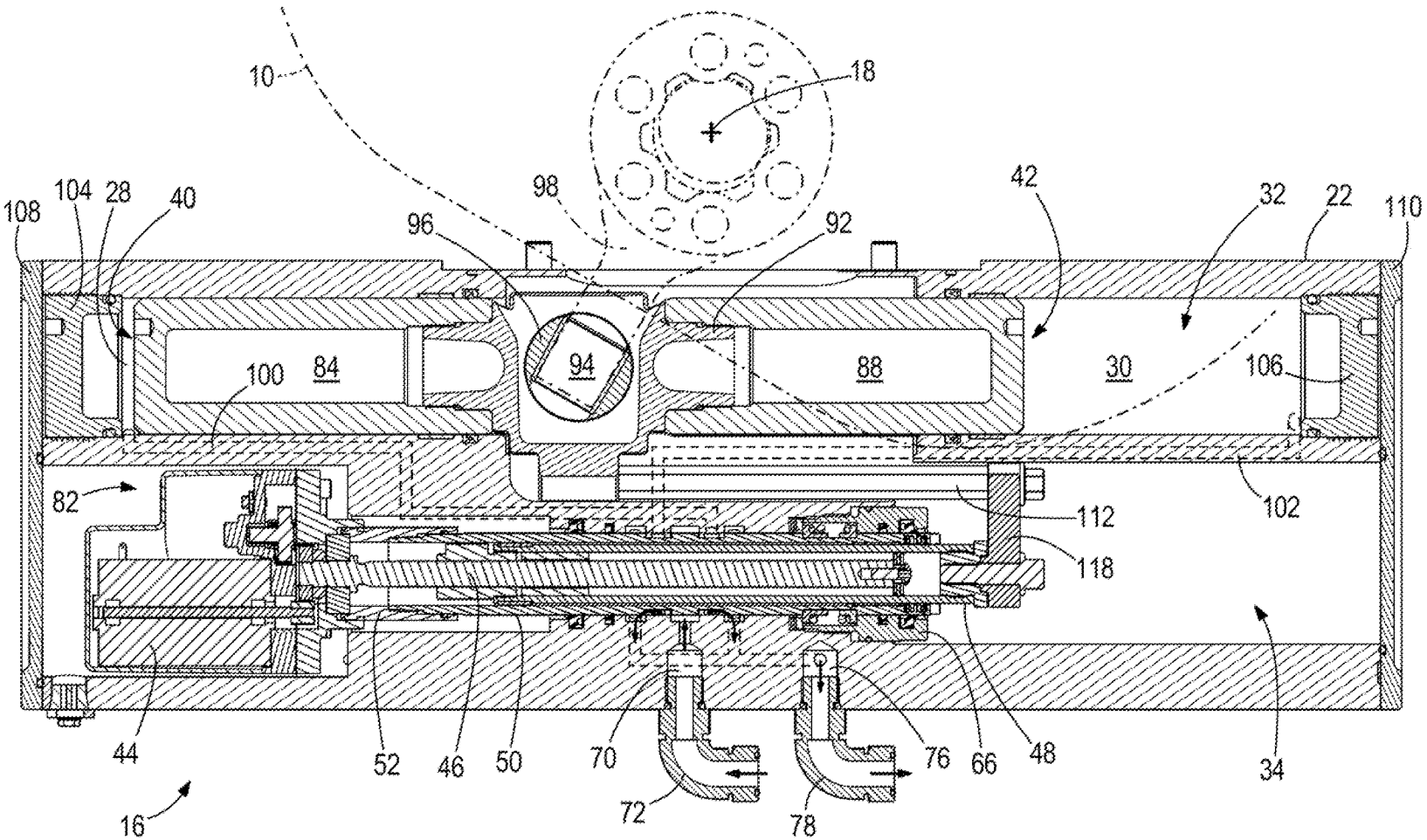
FIG. 5C is a sectional view of the steering actuator, showing the valve device back in the neutral position after pivoting movement of the outboard marine engine in a second pivot direction.
Figure 6:
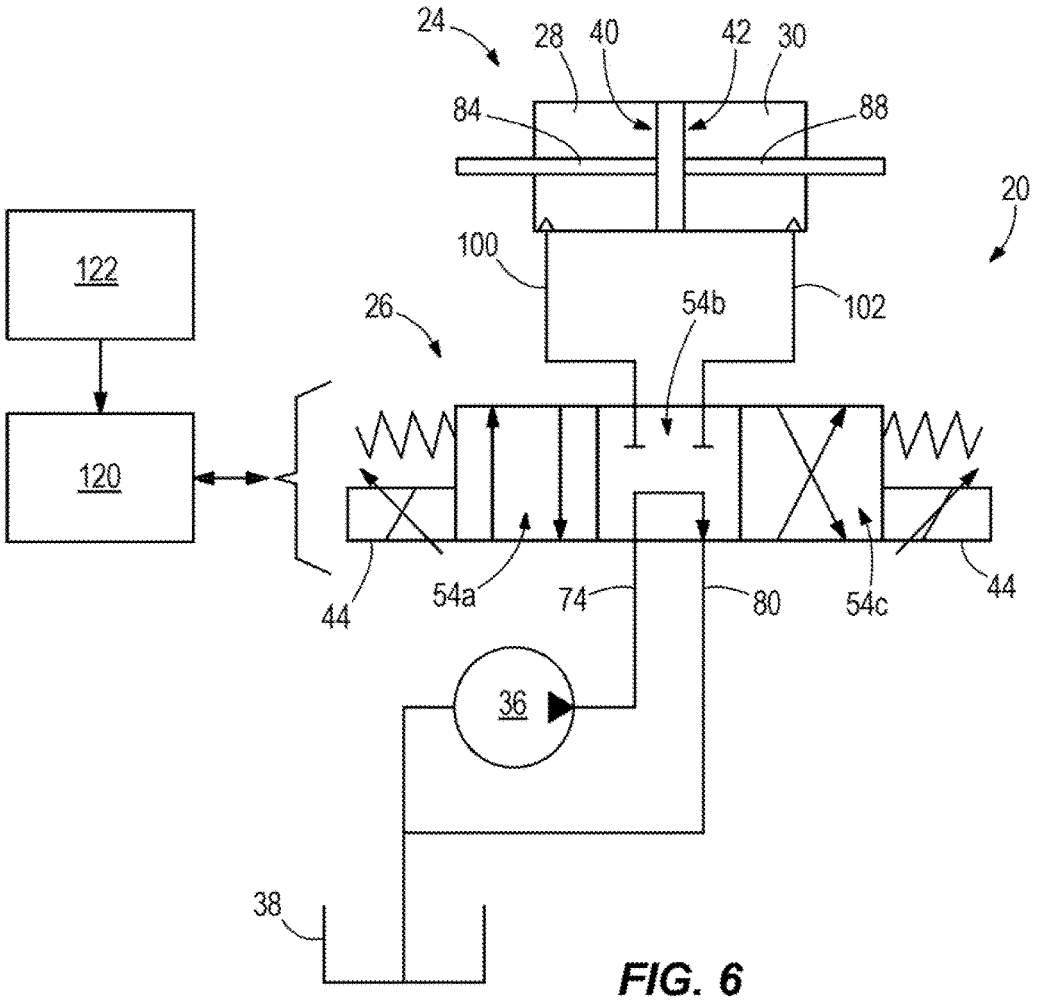
FIG. 6 is a schematic view of an exemplary system for steering the outboard marine engine.

When the output shaft 46 is not rotating, the natural resiliency of the springs 58 and Belleville washer springs 60 biases the valve device (including the spool 50) into the neutral position (shown in FIGS. 3, 4C and 5C). As mentioned above, positioning the valve device 26 in the neutral position causes hydraulic fluid from the pump 36 to be returned back to the tank 38. Movement of the spool 50 will cause corresponding movement of the bidirectional motor 44 and associated threaded connector 52 in a motor portion 82 of the second cavity 34.

With continued reference to FIG. 2, the piston device 24 has a first piston 84 that is on a first side 86 of the piston device 24 and a second piston 88 that is on an opposite, second side of the piston device 24. In this example, the piston device 24 also includes a center trunnion 92 that is disposed in the first cavity 32, between the first and second pistons 84, 86. A pivot pin 94 extends from the trunnion 92, transversely with respect to the first cavity 32, and is slidingly received in a transverse recess 93 formed in a vertical trunnion sleeve 96. The pivot pint 94 is configured to couple with a steering arm 98 on the outboard marine engine 10, as shown in dashed lines in FIGS. 3-5C. Axial movement of the trunnion 92 in the first cavity 32 causes the trunnion sleeve 96 to rotate about its own axis, which in turn causes movement of the steering arm 98 and pivoting movement of the outboard marine engine 10 about the vertical steering axis 18, as shown in FIGS. 3-5C. Bearing combinations 99 facilitate sliding of the first and second pistons 84, 88 within the first cavity 32.

Referring to FIGS. 3-5C, a first hydraulic fluid passageway 100 (shown in dashed line) conveys the flow the hydraulic fluid in the housing 22 from the valve device 26 to the first side 28 of the piston device 24 to thereby increase hydraulic fluid pressure on the first side 28. Increasing hydraulic fluid pressure on the first side 28 causes the first piston 84 to move, and thereby move the trunnion 92, in the first piston direction (i.e. to the right in the figures). A second hydraulic fluid passageway 102 (shown in dashed line) conveys the flow of hydraulic fluid in the housing 22 from the valve device 26 to the second side 30 of the piston device 24 to thereby increase the hydraulic fluid pressure in the second side 30. Increasing hydraulic fluid pressure on the second side 30 causes the second piston 88 to move, and thereby move the trunnion 96 in the opposite, second piston direction (i.e. to the left in the figures). As described, the flow of the hydraulic fluid to the first and second hydraulic fluid passageways 100, 102 is controlled by the valve device 26.

Referring to FIG. 2, a first removable end cap 104 is disposed on the first side of the piston device 24 and a second removable end cap 106 is disposed on the second side of the piston device 24. The first and second end caps 104, 106 enclose the piston device 24 in the first cavity 32. A first removable end plate 108 is disposed on the housing 22 and encloses the first end cap 104 in the housing 22. A second removable end plate 110 is on the housing 22 and encloses the second end cap 106 in the housing 22. A removable lower access panel 113 is connected to the housing 22 and encloses the first and second cavities 32, 34, thus providing access to the piston device 24 and valve device 26 for servicing.

A rigid position reference link 112 rigidly connects that valve device 26 to the piston device 24. The rigid position reference link 112 is entirely disposed in the housing 22. In this example, the rigid position reference link 112 is an elongated bar that has a first end 114 that is threaded to the trunnion 92 and a second end 116 that is threaded a link bracket 118 that is affixed to the end of the spool 50. As such, the trunnion 92 and spool 50 are fixed together, maintaining constant position reference between these respective components.

Operation of the steering actuator 16 will now be described with reference to FIGS. 3-5C and FIG. 6.

FIG. 3 depicts the valve device 26 in the neutral position wherein the valve device 26 is directing the flow of hydraulic fluid from the pump 36 back to the tank 38. The flow of hydraulic fluid enters the inlet 70 via the inlet fitting 72 and is channeled through the oil passages 54*b* (see FIG. 6) back to the tank 38 via the outlet 76 and outlet fitting 78. In this position, the springs 58, 60 act on the spring receiving groove 62 in the spool 50 to bias the spool 50 into the neutral position. The bidirectional motor 44 and threaded connector 52 are also biased into a neutral position, since they are connected to the spool 50. The pressure of the hydraulic fluid on the first and second sides 28, 30 of the piston device 24 is roughly equal and the outboard marine engine 10 is depicted in a straightforward orientation with respect to the vertical steering axis 18.

FIG. 4A depicts the steering actuator 16 upon an input to the controller 120 for steering movement of the outboard marine engine 10 in the first pivot direction. The controller 120 controls the bidirectional motor 44 to rotate the output shaft 46 in the noted first rotational direction, which causes axial travel of the output sleeve 48 out of the spool 50, away from the bidirectional motor 44. Initial movement of the output sleeve 48 (i.e. to the right in FIG. 4A) is prevented by the relative heavy weight of the outboard marine engine 10 acting against the end of the output sleeve 48. That is, the output sleeve 48 is connected to the outboard marine engine 10 via the rigid position reference link 112 and the trunnion 92. The force required to move the outboard marine engine 10 about the vertical steering axis 18 is greater than the force required to move the bidirectional motor 44, threaded connector 52 and spool 50 reversely in the motor portion 82 of the second cavity 34. As such, rotation of the bidirectional motor 44 in the first rotational direction causes the spool 50 and bidirectional motor 44 to move to the left in FIG. 4A, which causes the oil passages 54*a* on the spool 50 to align with the inlet 70 and outlet 76. This allows flow of hydraulic fluid from the pump 36 to the first hydraulic fluid passageway 100 and then into the first side 28 of the piston device 24. As shown in FIGS. 4B and 4C, increasing the flow of hydraulic fluid to the first side 28 of the piston device 24 via the first hydraulic fluid passageway 100 increases the pressure on the first side 28, which acts on the first piston 84 and causes the first piston 84 to move the piston device 24 in the first piston direction (i.e. to the right in the figures), which in turn, causes the outboard marine engine 10 to pivot in a first pivot direction, as shown in dashed lines in FIG. 4C. Once the requested pivoting movement of the outboard marine engine 10 is achieved (i.e. the requested pivoting movement that is input to the controller 120 via for example the input device 122), the controller 120 causes the bidirectional motor 44 to stop rotating the output shaft 46, which allows the springs 60, 62 to re-center the spool 50 such that the oil passages 54*b* divert the flow of hydraulic fluid from the pump 36 back to the tank 38, as shown in FIGS. 4C and 6.

FIGS. 5A-5C depict the steering actuator 16 during an input to the controller 120 for movement of the outboard marine engine 10 about the vertical pivot axis in the noted second pivot direction.

FIG. 5A depicts a steering actuator 16 upon an input to the controller 120 for steering movement of the outboard marine engine 10 in the second pivot direction. The controller 120 controls the bidirectional motor 44 to rotate the output shaft 46 in the noted second rotational direction, which causes axial travel of the output sleeve 48 into the spool 50, towards the bidirectional motor 44. Initial movement of the output sleeve 48 (i.e. to the left in FIG. 5A) is prevented by the relative heavy weight of the outboard marine engine 10 acting against the end of the output sleeve 48. That is, the output sleeve 48 is connected to the outboard marine engine 10 via the rigid position reference link 112 and the trunnion 92. The force required to move the outboard marine engine 10 about the vertical steering axis 18 is greater than the force required to move the bidirectional motor 44, threaded connector 52 and spool 50 in the motor portion 82 of the second cavity 34. As such, rotation of the bidirectional motor 44 in the second rotational direction causes the spool 50 and bidirectional motor 44 to move to the right in FIG. 5A, which causes the oil passages 54*c* on the spool 50 to align with the inlet 70 and outlet 76. This allows flow of hydraulic fluid from the pump 36 to the second hydraulic fluid passageway 102 and then into the second side 30 of the piston device 24. As shown by comparison of FIGS. 5A, 5B to FIG. 5C, increasing the flow of hydraulic fluid to the second side 30 of the piston device 24 via the second hydraulic fluid passageway 102 increases the pressure on the second side 30, which acts on the second piston 88 and causes the second piston 88 to move the piston device 24 in the second piston direction (i.e. to the left in the figures), which in turn, causes the outboard marine engine 10 to pivot in a first pivot direction, as shown in dashed lines in FIG. 5C. Once the requested pivoted movement of the outboard marine engine 10 is achieved (i.e. the requested pivoting movement input to the controller 120 via for example the input device 122), the controller 120 causes the bidirectional motor 44 to stop rotating the output shaft 46, which allows the springs 60, 62 to re-center the spool 50 such that the oil passages 54*b* divert the flow of hydraulic fluid from the pump 36 back to the tank 38, as shown in FIG. 5C.

Through research and development, the present inventors have determined that enclosing the steering actuator 16 in a housing 22, including for example enclosing the piston device 24, valve device 26, and rigid positional reference link 112 in the housing 22 avoids improper installation and functionality instigated by boat builders and/or customers. Enclosing the electrical components and steering actuator 16 in the housing 22 protects the electrical components and steering actuator 16 from exposure to the elements, which can undesirably lead to water infiltration into the piston device 24, valve device 26 and related hydraulic components. The examples shown in the figures is also much shorter in length than current steering actuators, which lessens packaging issues associated with assembly of the apparatus on the marine vessel.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A steering actuator for steering an outboard marine engine about a steering axis, the steering actuator comprising:

a housing;

a piston device that is disposed in the housing, wherein hydraulic actuation of the piston device causes the outboard marine engine to pivot about the steering axis; and a valve device that is disposed in the housing, wherein the valve device controls a flow of a hydraulic fluid to a first side of the piston device to move the piston device in a first piston direction in the housing and wherein the valve device alternately controls the flow of the hydraulic fluid to an opposite, second side of the piston device to move the piston device in an opposite, second piston direction in the housing;

wherein movement of the piston device in the first piston direction causes the outboard marine engine to pivot in a first pivot direction and wherein movement of the piston device in the second piston direction causes the outboard marine engine to pivot in an opposite, second pivot direction;

a rigid position reference link that rigidly connects the valve device to the piston device, wherein the rigid position reference link is entirely disposed in the housing;

wherein the piston device comprises a first piston coupled to a first side of the piston device and a second piston coupled to an opposite, second side of the piston device, and further comprising a first hydraulic fluid passageway that conveys the flow of the hydraulic fluid from the valve device to the first side of the piston device to thereby cause the first piston to move the piston device in the first piston direction and a second hydraulic fluid passageway that conveys the flow of the hydraulic fluid from the valve device to the second side of the piston device to thereby cause the second piston to move the piston device in the second piston direction, wherein the flow of the hydraulic fluid to the first and second hydraulic fluid passageways is controlled by the valve device.

2. The steering actuator according to claim 1, wherein the piston device is entirely disposed in a first cavity the housing.

3. The steering actuator according to claim 2, further comprising a first end cap on the first side of the piston device and a second end cap on the second side of the piston device, wherein the first and second end caps enclose the piston device in the first cavity.

4. The steering actuator according to claim 3, further comprising a first end plate on the housing that encloses the first end cap in the housing and an opposite, second end plate on the housing that encloses the second end cap in the housing.

5. The steering actuator according to claim 2, wherein the valve device is entirely disposed in a second cavity in the housing.

6. The steering actuator according to claim 5, wherein the valve device comprises three positions in the second cavity, including a first valve position wherein the valve device directs the flow of the hydraulic fluid to the first side of the piston device, a second valve position wherein the valve device directs the flow of hydraulic fluid to the second side of the piston device, and a neutral position wherein the valve device directs the flow of the hydraulic fluid back to a tank.

7. The steering actuator according to claim 6, wherein the valve device further comprises a bidirectional motor that causes the valve device to move out of the neutral position and into the first and second valve positions, respectively.

8. The steering actuator according to claim 7, wherein the valve device further comprises an output shaft, an output sleeve, and a spool, wherein the bidirectional motor rotates the output shaft in a first rotational direction and an opposite, second rotational direction, and wherein rotation of the output shaft in the first rotational direction causes linear travel of the output sleeve away from the bidirectional motor and wherein rotation of the output shaft in the second rotational direction causes linear travel of the output sleeve towards the bidirectional motor.

9. The steering actuator according to claim 8, wherein the valve device further comprises a return spring that biases the spool into the neutral position when the bidirectional motor is not rotating the output shaft.

10. The steering actuator according to claim 9, wherein the return spring comprises opposing first and second springs.

11. The steering actuator according to claim 8, wherein rotation of the output shaft in the first rotational direction moves the valve device into the first valve position and wherein rotation of the output shaft in the second rotational direction moves the valve device into the second valve position.

12. The steering actuator according to claim 1, further comprising an access door that is connected to the housing by removable fasteners such that removal of the fasteners provides access to both the piston device and the valve device.

13. A steering actuator for steering an outboard marine engine about a steering axis, the steering actuator comprising:

a housing;

a piston device that is disposed in the housing, wherein hydraulic actuation of the piston device causes the outboard marine engine to pivot about the steering axis; and a valve device that is disposed in the housing, wherein the valve device controls a flow of a hydraulic fluid to a first side of the piston device to move the piston device in a first piston direction in the housing and wherein the valve device alternately controls the flow of the hydraulic fluid to an opposite, second side of the piston device to move the piston device in an opposite, second piston direction in the housing;

wherein movement of the piston device in the first piston direction causes the outboard marine engine to pivot in a first pivot direction and wherein movement of the piston device in the second piston direction causes the outboard marine engine to pivot in an opposite, second pivot direction;

wherein the piston device comprises a trunnion that is disposed in the housing, wherein the steering actuator is coupled to the outboard marine engine via the trunnion.

14. The steering actuator according to claim 13, wherein hydraulic actuation of the piston device moves the trunnion and thereby moves the outboard marine engine.

15. The steering actuator according to claim 14, further comprising a pivot pin coupled to the trunnion, wherein the pivot pin is configured to couple the steering actuator to a steering arm of the outboard marine engine, wherein the pivot pin pivots about a vertical pivot axis as the trunnion is moved by the piston device.

16. A system for steering an outboard marine engine about a steering axis, the system comprising:

an outboard marine engine;

a steering actuator that comprises:

a housing;

a piston device that is disposed in the housing, wherein hydraulic actuation of the piston device causes the outboard marine engine to pivot about the steering axis; and a valve device that is disposed in the housing, wherein the valve device controls a flow of a hydraulic fluid to a first side of the piston device to move the piston device in a first piston direction in the housing and wherein the valve device alternately controls the flow of the hydraulic fluid to an opposite, second side of the piston device to move the piston device in an opposite, second piston direction in the housing;

wherein movement of the piston device in the first piston direction causes the outboard marine engine to pivot in a first pivot direction and wherein movement of the piston device in the second piston direction causes the outboard marine engine to pivot in an opposite, second pivot direction; and a controller that controls the valve device;

a rigid position reference link that rigidly connects the valve device to the piston device, wherein the rigid position reference link is entirely disposed in the housing, wherein the controller is configured to determine a relative position between the outboard marine engine and steering actuator based upon a location of the rigid position reference link;

wherein the valve device comprises three positions in the second cavity, including a first valve position wherein the valve device directs the flow of the hydraulic fluid to the first side of the piston device, a second valve position wherein the valve device directs the flow of hydraulic fluid to the second side of the piston device, and a neutral position wherein the valve device directs the flow of the hydraulic fluid back to a tank, wherein the valve device further comprises a bidirectional motor that causes the valve device to move out of the neutral position and into the first and second valve positions, respectively; and wherein the controller is configured to control the bidirectional motor to thereby move the valve device out of the neutral position and into the first and second valve positions, respectively;

wherein the piston device comprises a first piston coupled to a first side of the piston device and a second piston coupled to an opposite, second side of the piston device, and further comprising a first hydraulic fluid passageway that conveys the flow of the hydraulic fluid from the valve device to the first side of the piston device to thereby cause the first piston to move the piston device in the first piston direction and a second hydraulic fluid passageway that conveys the flow of the hydraulic fluid from the valve device to the second side of the piston device to thereby cause the second piston to move the piston device in the second piston direction, wherein the flow of the hydraulic fluid to the first and second hydraulic fluid passageways is controlled by the valve device.

* * * * *